US008773326B2

(12) United States Patent
Yamamoto et al.

(10) Patent No.: US 8,773,326 B2
(45) Date of Patent: Jul. 8, 2014

(54) TERMINAL DEVICE AND RECORDING MEDIUM WITH CONTROL PROGRAM RECORDED THEREIN

(75) Inventors: Shinya Yamamoto, Kanagawa (JP); Hideaki Aihara, Kanagawa (JP)

(73) Assignee: NEC Casio Mobile Communications Ltd., Kanagawa (JP)

( * ) Notice: Subject to any disclaimer, the term of this patent is extended or adjusted under 35 U.S.C. 154(b) by 270 days.

(21) Appl. No.: 13/083,268

(22) Filed: Apr. 8, 2011

(65) Prior Publication Data

US 2011/0249042 A1 Oct. 13, 2011

(30) Foreign Application Priority Data

Apr. 8, 2010 (JP) ..... 2010-089485

(51) Int. Cl.
*G09G 5/00* (2006.01)
*G09G 5/10* (2006.01)

(52) U.S. Cl.
USPC ..... 345/1.3; 345/690

(58) Field of Classification Search
USPC ..... 345/1.3
See application file for complete search history.

(56) References Cited

U.S. PATENT DOCUMENTS

| | | | | |
|---|---|---|---|---|
| 2005/0093958 | A1* | 5/2005 | Mori et al. | 347/207 |
| 2006/0001647 | A1* | 1/2006 | Carroll | 345/156 |
| 2009/0002285 | A1* | 1/2009 | Baba et al. | 345/77 |
| 2010/0053069 | A1* | 3/2010 | Tricoukes et al. | 345/156 |
| 2010/0321275 | A1* | 12/2010 | Hinckley et al. | 345/1.3 |
| 2011/0122107 | A1 | 5/2011 | Onkura | |

FOREIGN PATENT DOCUMENTS

| | | | |
|---|---|---|---|
| JP | 2003158573 | A | 5/2003 |
| JP | 2005221907 | A | 8/2005 |
| JP | 2006243360 | A | 9/2006 |
| JP | 2010-004462 | A | 1/2010 |
| JP | 2011113108 | A | 6/2011 |

OTHER PUBLICATIONS

Office Action dated Oct. 29, 2013, issued by the Japan Patent Office in corresponding Japanese Application No. 2010-089485.

* cited by examiner

*Primary Examiner* — Alexander Eisen
*Assistant Examiner* — Mark Regn
(74) *Attorney, Agent, or Firm* — Sughrue Mion, PLLC

(57) ABSTRACT

In a terminal device, when an opening angle of two display section housings is detected by an opening angle detecting section 17, and the opening angle is smaller than a predetermined angle (such as 90°), a control section 11 controls luminance of at least one of display sections 4 and 5 included in the display section housings, based on the opening angle. In a case where the display sections 4 and 5 are display devices that use backlights 8 and 9, the control section 11 controls luminance of at least one of the backlights 8 and 9 illuminating the display sections 4 and 5.

12 Claims, 9 Drawing Sheets

FIG. 3

BT

BACKLIGHT CONTROL TABLE

| OPENING ANGLE | DRIVE CURRENT ANGLE CORRECTION |
|---|---|
| EQUAL TO OR MORE THAN 90° | × 1 |
| LESS THAN 90° BUT EQUAL TO OR MORE THAN 60° | ×0.8 |
| LESS THAN 60° BUT EQUAL TO OR MORE THAN 45° | ×0.6 |
| LESS THAN 45° BUT EQUAL TO OR MORE THAN 30° | ×0.4 |
| LESS THAN 30° | OFF |

1 DISPLAY SECTION HOUSING
2 DISPLAY SECTION HOUSING
3 HINGE SECTION
4
5
60°
60°
60°
60°
70°
70°
40°
40°
80°
GROUND (HORIZONTAL PLANE)

IMAGE CAPTURED BY IN-CAMERA ON DISPLAY SECTION 4 SIDE

IMAGE CAPTURED BY IN-CAMERA ON DISPLAY SECTION 5 SIDE

TERMINAL DEVICE AND RECORDING MEDIUM WITH CONTROL PROGRAM RECORDED THEREIN

CROSS-REFERENCE TO RELATED APPLICATION

This application is based upon and claims the benefit of priority from the prior Japanese Patent Application No. 2010-089485, filed Apr. 8, 2010, the entire contents of which is incorporated herein by reference.

BACKGROUND OF THE INVENTION

1. Field of the Invention

The present invention relates to a terminal device structured by two housings respectively having a display section being foldably connected via a hinge section, and a recording medium with a control program for the terminal device recorded therein.

2. Description of the Related Art

In recent years, terminal devices such as mobile phones have become increasingly sophisticated, and the screen size has been increased along with it. However, the screen size is limited due to their portability, and therefore the increase of the screen size has been actualized by a plurality of display sections being provided. For example, in a terminal device whose two housings are foldably connected via a hinge section, the increase of the screen size is actualized by a display section being provided in each housing and these two display sections being openable in a manner similar to a book.

When using a terminal device such as this, the user often views the screens with the housings opened at a small opening angle so as to keep other people from peeking at the screens or not to annoy others in crowded areas such as inside a train. However, when the opening angle is small, the contents of each display screen are reflected in the other screen by reflected light. Accordingly, the visibility of the screens is significantly reduced, and the screens become difficult to view. This problem becomes more prominent as the brightness of the screens is increased.

Therefore, conventionally, a technology has been proposed in which information regarding the occurrence of reflection is managed inside a foldable terminal device, and image quality correction is performed on relevant display areas to prevent reflection (refer to, for example, Japanese Patent Application Laid-Open (Kokai) Publication No. 2010-004462).

However, in the above described technology, various information is required to be stored and managed for each folding angle. Therefore, there is a problem in that the amount of information becomes enormous and, when image quality correction is performed based on this enormous information, processing therefore becomes complicated. In addition, information to be stored and managed therein is limited to fixed information, such as information related to keypads.

SUMMARY OF THE INVENTION

An object of the present invention is to effectively reduce the reflection of the contents of each display section in the other display section, even in a terminal device whose two housings respectively having a display section are foldably connected via a hinge section.

In accordance with one aspect of the present invention, there is provided a terminal device including two housings respectively having a display section which are foldably connected via a hinge section, comprising: an opening angle judgment means for detecting an opening angle of the two housings, and judging whether or not the opening angle is smaller than a predetermined angle; and a display control means for controlling luminance of at least one display section of the two housings based on the opening angle, when the opening angle judgment means judges that the opening angle is smaller than the predetermined angle.

In accordance with another aspect of the present invention, there is provided a non-transitory computer-readable storage medium having stored thereon a program that is executable by a computer, the program being executable by the computer to perform functions comprising: processing for detecting an opening angle of two housings respectively having a display section which are foldably connected via a hinge section, and judging whether or not the opening angle is smaller than a predetermined angle; and processing for controlling luminance of the display section based on the opening angle, when the opening angle is judged to be smaller than the predetermined angle.

According to the present invention, the reflection of the contents of each display section in the other display section is effectively reduced even in a terminal device whose two housings respectively having a display section are foldably connected via a hinge section, whereby the visibility of the display sections is improved.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 3 is a diagram for explaining a backlight control table BT;

DETAILED DESCRIPTION OF THE PREFERRED EMBODIMENTS

The present invention will hereinafter be described in detail with reference to the preferred embodiments shown in the accompanying drawings.

First Embodiment

A first embodiment of the present invention will be described with reference to FIG. 1 to FIG. 5.

Figure 1:
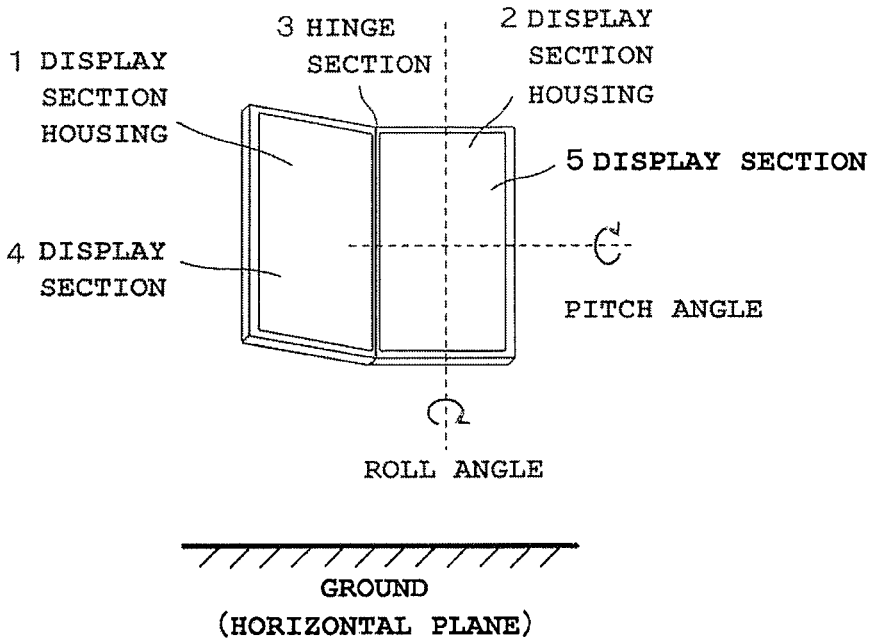
FIG. 1 is an outer appearance view of a mobile phone 100 to which the present invention has been applied.

The first embodiment is an example in which the present invention has been applied to a mobile phone 100, and FIG. 1 is an outer appearance view of this mobile phone 100.

The mobile phone 100 has a call function (voice call function and videophone function), an electronic mail function, an internet connection function (web access function), an electronic book viewing function, etc. As shown in FIG. 1, the mobile phone 100 is a foldable-type mobile phone whose two housings respectively having a display section, which are a display section housing 1 and a display section housing 2, are foldably connected (so as to be openable and closable) via a hinge section 3. The electronic book viewing function is a function that allocates data amounting to a plurality of pages to the respective display sections of the display section housings 1 and 2, and displays the data in the page sequence.

The display section housing 1 includes a display section 4, and the display section housing 2 includes a display section 5. These display section housings 1 and 2 are respectively composed of rectangular bodies of the same shape and size. In FIG. 1, the vertically long display housings 1 and 2 are in an opened state where they are horizontally aligned (horizontally opened state). That is, the display housings 1 and 2 are in a vertically oriented state where the overall terminal housing is horizontally long. In this vertically oriented state (horizontally opened state), the display section housing 1 is positioned on the left side and the display section housing 2 is positioned on the right side in FIG. 1. The hinge section 3 is a connecting section enabling the display section housings 1 and 2 to be openable and closable, by which they can be changed from an overlapped state to an opened state (a state in which the display section housings 1 and 2 are opened at 180°). The display sections 4 and 5, which are rectangular liquid crystal display sections having the same shape and size, are arranged on substantially the overall front surfaces of the display section housings 1 and 2, and each of which has a backlight (not shown in FIG. 1) used for illumination thereof.

Figure 2:
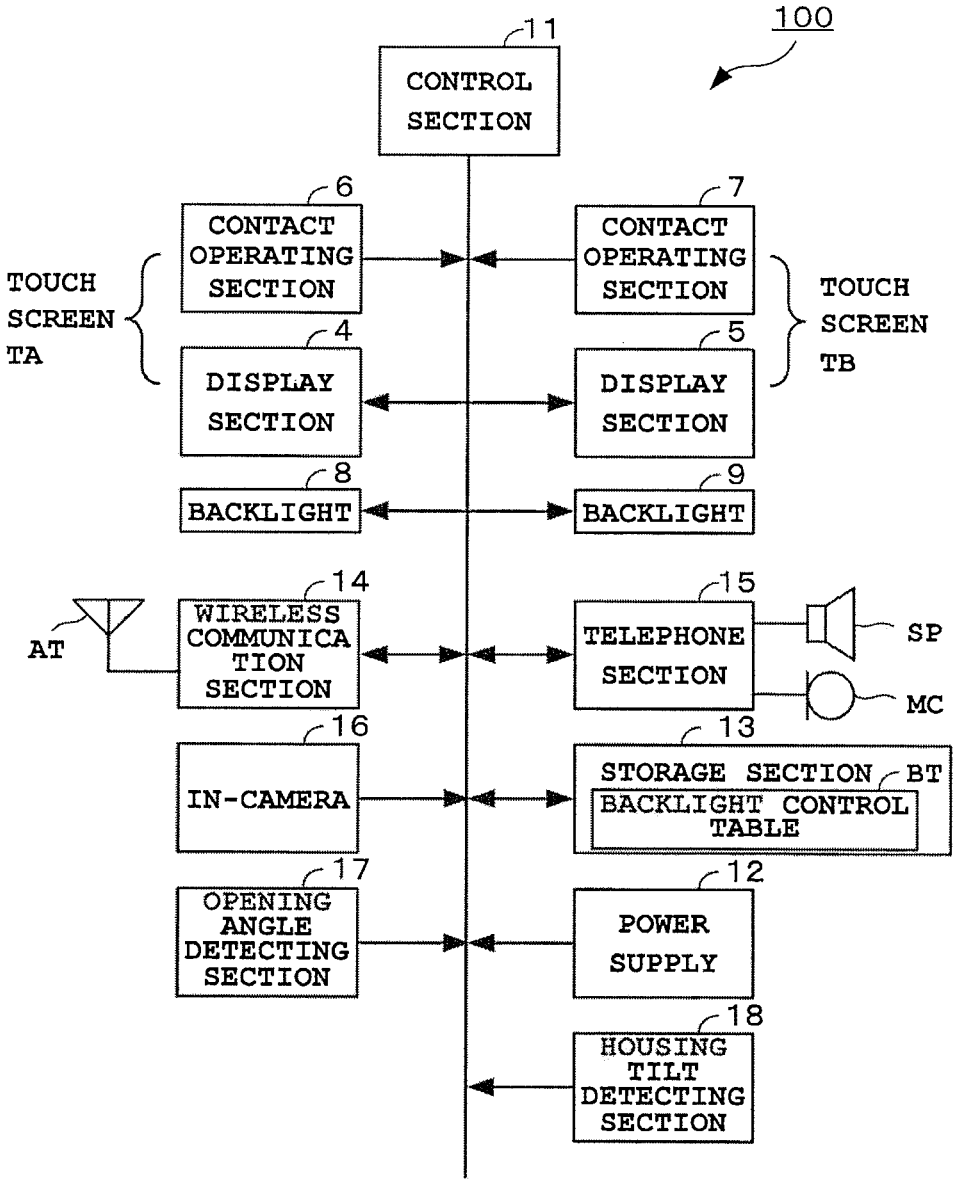
FIG. 2 is a block diagram showing basic components of the mobile phone 100.

FIG. 2 is a block diagram showing basic components of the mobile phone 100.

A control section 11 (display control means, focus judgment means, opening angle judgment means, and angle difference judgment means), which operates by receiving power supply from a power supply section 12 including a secondary battery, is provided with a central processing unit (CPU), a memory, and the like (not shown), and controls the overall operations of the mobile phone 100 in accordance with various programs stored in a storage section 13. The storage section 13 is an internal memory, such as a read-only memory (ROM) or a random access memory (RAM), and has a program area and a data area (not shown). The program area of the storage section 13 stores programs for actualizing the present embodiment based on operation procedures shown in FIG. 4 described hereafter, and the data area of the storage section 13, which is provided with a backlight control table BT described hereafter, stores various flag information and various information required to operate the mobile phone 100. Note that the storage section 13 may be, for example, structured to include a detachable portable memory (recording media) such as a secure digital (SD) card or an integrated circuit (IC) card. Alternatively, the storage section 13 may be structured to be provided on a predetermined external server (not shown).

The display sections 4 and 5 constitute touch screens TA and TB, and the touch screens TA and TB are structured by contact operating sections (transparent touch panels) 6 and 7 being layered over the display sections 4 and 5. The contact operating sections 6 and 7 corresponds to the surfaces of the display sections 4 and 5, and detects finger contact. Note that the touch panels 6 and 7 may use a capacitance method, a resistive film method, or a piezoelectric method that enables the detection of pressing (pressure) by an operating instrument or a finger, in addition to contact. In the first embodiment, the capacitance method, which detects human contact, is used.

The touch screens TA and TB are used to dial a number, enter text, enter a command, etc., and the control section 11 performs various types of processing such as transmission processing, electronic mail reception processing, and camera processing as processing based on operation signals sent from the touch screens TA and TB. In addition, the touch screens TA and TB display an idling screen, icons, date and time information, text data, mail, web pages, and the like. Also, when the camera function is running, the touch screens TA and TB serves as a view finder screen that displays a live-view image. Backlights (such as fluorescent tubes) that illuminate the display sections 4 and 5 are provided near the display sections 4 and 5.

A wireless communication section 14 includes a wireless section, a baseband section, a demultiplexing section, and the like (not shown), and exchanges data with the nearest base station during the operation of, for example, the voice call function, the electronic mail function, or the internet connection function. When the call function is running, the wireless communication section 14 receives signals from the receiving side of the baseband section, and after demodulating the signals into reception baseband signals, outputs the reception baseband signals as audio from a call speaker SP via a phone section 15. The wireless communication section 14 also receives, from the phone section 15, audio data inputted from a call microphone MC, and after encoding the audio data into transmission baseband signals, sends the encoded transmission baseband signals to the transmitting side of the baseband section, and transmits the encoded transmission baseband signals from an antenna AT.

An in-camera 16 is an imaging section used for videophone, by which the user's face or the like is captured during a call. This in-camera 16 includes an imaging lens, an image sensor element, a drive system for the image sensor element, a distance sensor, a light quantity sensor, an analog processing circuit, a signal processing circuit, etc., and is provided in the hinge section 3 on the inner side of the housing. Note that the in-camera 16 is used in a second embodiment described hereafter. An opening angle detecting section 17 is provided in the hinge section 3, and detects an angle (opening angle) at which the display section housings 1 and 2 are opened. The function of the opening angle judgment means is actualized by this opening angle detecting section 17 and the control section 11. Note that the opening angle detecting section 17 has a rotary-type switch structure in which an opening angle (0° to 360°) is detected by a movable contact that rotates with the rotation of the hinge section 3 coming into contact with a fixed contact. However, the structure of the opening angle detecting section 17 may be discretionarily determined, and may be a structure in which an opening angle is detected optically or magnetically. Also note that an angle of 0° to 180° may be detected as an opening angle.

Based on a detection result from the opening angle detecting section 17, the control section 11 judges whether or not the opening angle is smaller than a predetermined angle (90° according to the first embodiment). Then, based on this judgment result, the control section 11 judges whether or not the contents of each display screen are likely to be reflected in the other screen by reflected light. When the opening angle is smaller than 90°, the control section 11 judges that reflection such as this is likely to occur, and controls the luminance of the backlights 8 and 9. In this instance, the control section 11 reduces or turns off the luminance of at least one of the backlights 8 and 9 depending on the opening angle.

A housing tilt detecting section 18 is a three-axis-type acceleration sensor that detects a tilt angle of each display section housing 1 and 2 from a horizontal plane in a direction in which the display section housings 1 and 2 are opened, when the display section housings 1 and 2 are in a opened state with the hinge section 3 therebetween. The function of the angle difference judgment means is actualized by this housing tilt detecting section 18 and the control section 11. The housing tilt detecting section 18 is mounted on a substrate inside the display section housing 2 that is one of the display section housings 1 and 2, and is capable of detecting the XYZ axis directions, pitch angle, and roll angle of the display section housing 2, as shown in FIG. 1. Note that the pitch angle herein refers to the rotation angle of the long side of the display section housing 2, and the roll angle herein refers to the rotation angle of the short side of the display section housing 2. A roll angle from the horizontal plane is the tilt angle of the housing. Also note that the tilt angle of the other display section housing 1 is calculated by a following equation, based on the roll angle of the display section housing 2 detected by the housing tilt detecting section 18 and an opening angle detected by the opening angle detecting section 17.

Tilt angle of display section housing 1=180°−(roll angle of display section housing 2 from horizontal plane+opening angle)

The control section 11 detects an angle difference based on the roll angles of the display section housings 1 and 2 detected by the housing tilt detecting section 18, and judges whether the user is more likely to be viewing both display sections 4 and 5, or more likely to be viewing either one of the display sections 4 and 5, based on whether or not the angle difference is greater than a predetermined angle (such as 20°). In this instance, when the user is more likely to be viewing both display sections 4 and 5, the control section 11 controls the luminance of both backlights 8 and 9. When the user is more likely to be viewing either one of the display sections 4 and 5, the control section 11 controls the luminance of the backlight in the other display section.

FIG. 3 is a diagram for explaining the backlight control table BT.

The backlight control table BT is a control table that is used to, when the opening angle of the display section housings 1 and 2 is smaller than a predetermined angle, perform processing to control the luminance of at least one of the display sections included in the two display section housings 1 and 2 based on the opening angle, and has an "opening angle" field and a "drive current angle correction" field. The "opening angle" field is divided into "equal to or more than 90°", "less than 90° but equal to or more than 60°", "less than 60° but equal to or more than 45°", "less than 45° but equal to or more than 30°", and "less than 30°", and used to judge to which of these ranges an opening angle detected by the opening angle detecting section 17 belongs.

The "drive current angle correction" field stores correction values for correcting drive current for driving the backlights 8 and 9 that illuminate the display screens of the display sections 4 and 5, such that the luminance of each backlight 8 and 9 is reduced in stages as the "opening angle" becomes smaller. That is, in the example in FIG. 3, "×1" is stored as the "drive current angle correction" corresponding to the "opening angle" of "equal to or more than 90°", "×0.8" is stored as the "drive current angle correction" corresponding to "less than 90° but equal to or more than 60°", "×0.6" is stored as the "drive current angle correction" corresponding to "less than 45° but equal to or more than 30°", "×0.4" is stored as the "drive current angle correction" corresponding to "less than 45° but equal to or more than 30°", and "OFF" is stored as the "drive current angle correction" corresponding to "less than 30°".

The value "×1" of the "drive current angle correction" is a correction value indicating that the backlights 8 and 9 are driven with ordinary luminance. When the "opening angle" is "equal to or more than 90°", the backlights 8 and 9 are driven with ordinary luminance. However, when the "opening angle" becomes smaller than the predetermined angle "90°", the "drive current angle correction" becomes "×1", "×0.8", "×0.6", "×0.4", "OFF" depending on the "opening angle", and the luminance is reduced in stages depending on the opening angle. That is, because reflection such as described above occurs more easily as the opening angle becomes smaller, the luminance of the backlights 8 and 9 is reduced (darkened) in stages. The value "OFF" of the "drive current angle correction" is a correction value of when the "opening angle" is "less than 30°", or in other words, when the possibility that the user is viewing neither display section 4 or 5 is extremely high. In such cases, both backlights 8 and 9 are in an OFF state (turned OFF).

Next, an operation concept of the mobile phone 100 according to the first embodiment will be described with reference to the flowchart shown in FIG. 4. Each function described in the flowchart is stored in a readable program code format, and operations in accordance with the program codes are sequentially performed in the mobile phone 100. Note that, in the mobile phone 100, Operations in accordance with the program codes transmitted from a transmitting medium, such as a network, may be sequentially performed. That is, operations unique to the embodiment may be performed using programs and data provided from an external source via a transmitting medium, in addition to a recording medium. This applies to other embodiments described later.

Figure 4:
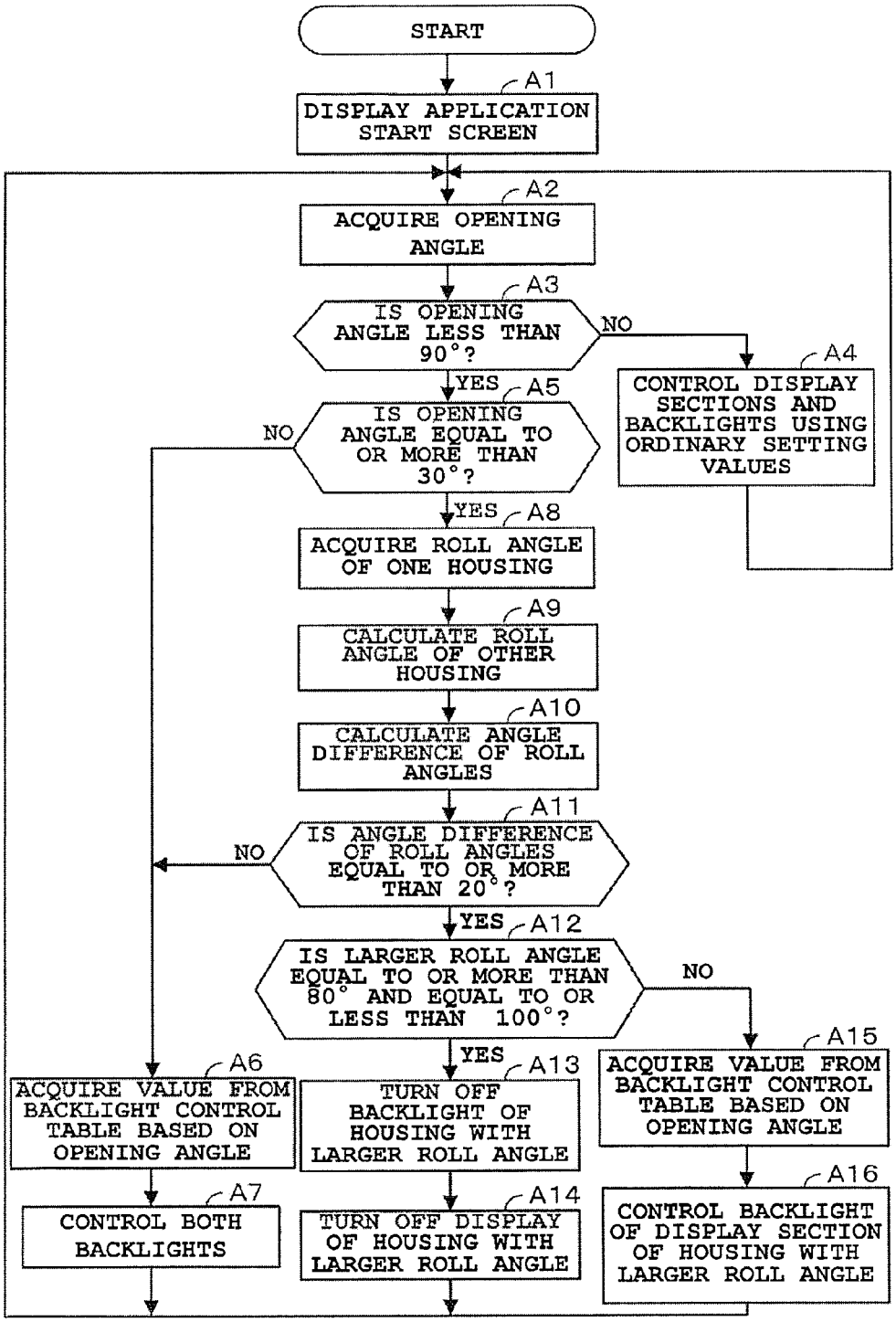
FIG. 4 is a flowchart outlining operations of the characteristic portion of a first embodiment which are activated with the initiation of a selected application.
Figures 5A, 5B, 5C:
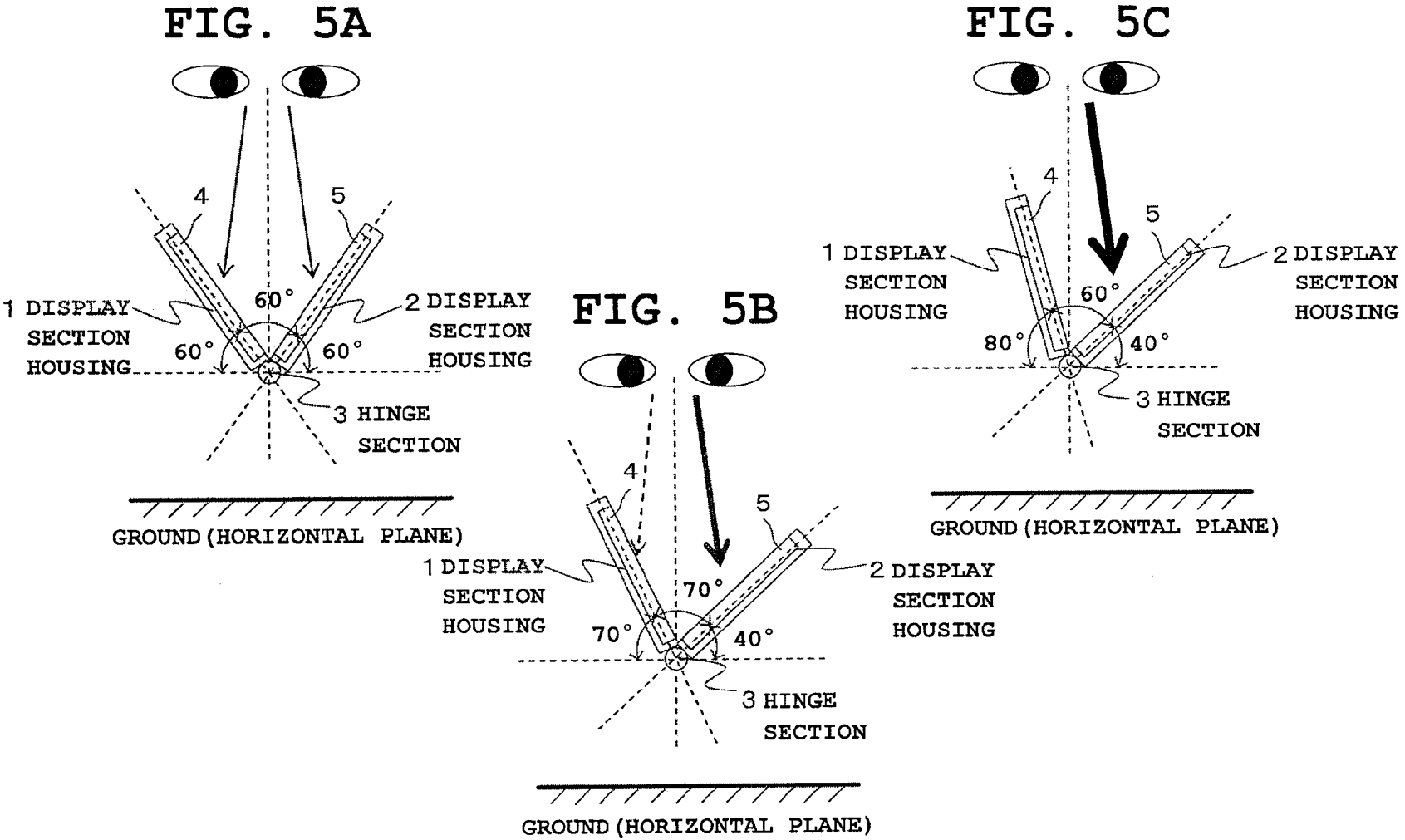
FIG. 5A to FIG. 5C are diagrams showing examples where the opening angle of a display section housing 1 and a display section housing 2 is less than a predetermined angle (90°), and whether the user is viewing a display section 4 or a display section 5 is judged based on the tilt angles of the display section housing 1 and the display section housing 2.

FIG. 4 is a flowchart outlining operations of the characteristic portion of this embodiment from among all of the operations of the mobile phone 100. These operations are activated with the initiation of a selected application. Note that, after exiting the flow in FIG. 4, the procedure returns to the main flow (not shown) of the overall operation. The flowchart in FIG. 4 will hereinafter be described with reference to the detailed examples shown in FIG. 5A to FIG. 5C. FIG. 5A to FIG. 5C are diagrams showing examples where the opening angle of the display section housings 1 and 2 is less than a predetermined angle (90°), and whether the user is viewing the display section 4 or the display section 5 is judged based on the tilt angles (roll angles from the horizontal plane) of the display section housings 1 and 2.

That is, FIG. 5A shows an example where the user is judged to be viewing both display sections 4 and 5, in which the opening angle of the display section housings 1 and 2 is 60°, and roll angles from the horizontal plane of the display section housings 1 and 2 are both 60°. FIG. 5B shows an example where the user is judged to be viewing the display sections 4 and 5 while focusing on one display section, in which the opening angle of the display section housings 1 and 2 is 70°, a roll angle from the horizontal plane of the display section housing 1 is 70°, and a roll angle from the horizontal plane of the display section housing 2 is 40°. FIG. 5C shows an example where the user is judged to be viewing only one display section, in which the opening angle of the display section housings 1 and 2 is 70°, a roll angle from the horizontal plane of the display section housing 1 is 80°, and a roll angle from the horizontal plane of the display section housing 2 is 40°.

First, when a selected application (such as the electronic book viewing function) is activated, the control section 11 displays its application screen on the display sections 4 and 5 (Step A1), and after acquiring a detection result from the opening angle detecting section 17 (Step A2), judges whether or not the "opening angle" is less than 90° (Step A3). When judged that the "opening angle" is equal to or more than 90° (NO at Step A3), the control section 11 controls the display sections 4 and 5 and the backlights 8 and 9 using ordinary setting values (Step A4). In this case, "×1" has been set as the "drive current angle correction" corresponding to when the "opening angle" is equal to or more than 90° in the backlight control table BT. Therefore, the control section 11 drives the backlights 8 and 9 with ordinary luminance. Then, the control section 11 returns to Step A2, and thereafter drives the backlights 8 and 9 with ordinary luminance in the same manner, on the condition that "the opening angle" is equal to or more than 90°.

Conversely, when judged that the "opening angle" is less than a predetermined angle (90°) (YES at Step A3), the control section 11 further judges whether or not "the opening angle" is equal to or more than another predetermined angle (30°) (Step A5). When judged that the "opening angle" is less than 30° (NO at Step A5), the control section 11 judges that the user is likely to be viewing neither display section 4 or 5, and after proceeding to Step A6, reads out a corresponding "drive current angle correction" based on the opening angle, with reference to the backlight control table BT. Then, based on this "drive current angle correction", the control section 11 controls each of the backlights 8 and 9 corresponding to the display sections 4 and 5 (Step A7). In this instance, since the "drive current angle correction" when the opening angle is equal to or less than 30° is "OFF", the control section 11 turns OFF both backlights 8 and 9. Then, the control section 11 returns to the above-described Step A2.

In FIG. 5A to FIG. 5C, the "opening angle" is 60°, 70°, and 60°, respectively. In any of these cases, the "opening angle" is less than 90° (YES at Step A3) and equal to or more than 30° (YES at Step A5), and therefore the control section 11 judges that the user is likely to be viewing at least one of the display sections 4 and 5, and further judges that the contents of each display section 4 and 5 are likely to be reflected in the other display section by reflected light. Accordingly, the control section 11 proceeds to subsequent Step A8, and after acquiring the roll angle of one display section housing from the housing tilt detecting section 18, calculates the roll angle of the other display section housing from the acquired roll angle, using the following equation (Step A9).

Tilt angle of display section housing 1=180°−(roll angle from horizontal plane of display section housing 2+opening angle).

Then, the control section 11 determines the difference of the roll angles of the display section housings 1 and 2 (Step A10), and judges whether or not this angle difference is greater than a predetermined angle (20° in the examples in the drawings) (Step A11). In the instance shown in FIG. 5A, roll angles from the horizontal plane of the display section housings 1 and 2 are both 60°, and the angle difference thereof is 0°. Since the angle difference is less than the above-described predetermined angle (such as 20°) (NO at Step A11), the control section 11 judges that the user is viewing both display sections 4 and 5, and after proceeding to Step A6, reads out a corresponding "drive current angle correction" based on the opening angle, with reference to the backlight control table BT. Then, based on this "drive current angle correction", the control section drives each of the backlights 8 and 9 corresponding to the display sections 4 and 5 (Step A7).

In the instance shown in FIG. 5A, the opening angle is 60°, and therefore the "drive current angle correction" is "×0.8". Accordingly, each backlight 8 and 9 is driven with a luminance that is 20% lower than the ordinary luminance. In the instance shown in FIG. 5B, the roll angle of the display section housing 1 is 70° from the horizontal plane, the roll angle of the display section housing 2 is 40° from the horizontal plane, and the angle difference thereof is 30°. Since the angle difference is equal to or more than the above-described predetermined angle (such as 20°) (YES at Step A11), the control section 11 proceeds to subsequent Step A12, and judges whether or not the larger roll angle is equal to or more than 80° and equal to or less than 100°, or in other words, judges whether or not the display section housing is in a substantially vertical state (a state in which the display section housing is almost vertical) (Step A12). Then, since the larger roll angle is 70° and the display section housing is not in a substantially vertical state (NO at Step A12), the control section 11 judges that the user is mainly viewing the display section included in the display section housing with the smaller roll angle, and after proceeding to Step A15, reads out a corresponding "drive current angle correction" based on the opening angle, with reference to the backlight control table BT. Next, based on this "drive current angle correction", the control section 11 drives the backlight of the display section included in the display section housing with the larger roll angle (Step A16).

In the instance in FIG. 5B as well, the opening angle is "60°", and therefore the "drive current angle correction" is "×0.8". Accordingly, the backlight 8 of the display section 4 included in the display section housing 1 with the larger roll angle is driven with a luminance that is lower by 20% than ordinary luminance. Then, the procedure returns to above-described Step A2.

In the instance in FIG. 5C, the roll angle of the display section housing 1 is 80° from the horizontal plane, the roll angle of the display section housing 2 is 40° from the horizontal plane, and the angle difference is 40°. Since the angle difference is equal to or more than the above-described predetermined angle (such as 20°) (YES at Step A11), the control section 11 judges whether or not the larger roll angle is equal to or more than 80° and equal to or less than 100°, or in other words, judges whether or not the display section housing is in a substantially vertical state (a state in which the display section housing is almost vertical), as in the above described case (Step A12). Then, since the larger roll angle is 80° and the display section housing is in a substantially vertical state (YES at Step A12) the control section 11 judges that the user is viewing only the display section included in the display section housing with the smaller roll angle, and after proceeding to Step A13, turns OFF the backlight of the display section included in the display section housing with the larger roll angle so as to set the luminance in an OFF state (Step A13), and sets the display of this display section in an OFF state (power supply blocked state) (Step A14). In the instance in FIG. 5C, the control section 11 turns OFF the backlight 8 of the display section 4 included in the display section housing 1 with the larger roll angle, and sets the display of the display section 4 in an OFF state. Then, the control section 11 then returns to above-described Step A2.

As described above, in the first embodiment, when the opening angle of the display section housings 1 and 2 detected by the opening angle detecting section 17 is less than a predetermined angle, the control section 11 controls the luminance of at least one of the display sections 4 and 5 included in the display section housings 1 and 2 based on the opening angle. Therefore, even when the user is viewing the screens with the housings opened at a small opening angle so as to keep other people from peeking at the screens or not to annoy others in crowded areas such as inside a train, the reflection of the contents of each display section in the other display section is effectively reduced, whereby reduction in the visibility (viewability) of the display sections can be prevented.

In addition, the display sections 4 and 5 are display devices that use the backlights 8 and 9, and the luminance of these backlights 8 and 9 are reduced. Therefore, reflection that occurs in a display device using a backlight is effectively reduced.

Moreover, when the opening angle of the display section housings 1 and 2 is less than a predetermined angle, if the difference of the tilt angles (roll angles from the horizontal plane) of the display section housings 1 and 2 detected by the housing tilt detecting section 18 is greater than a predetermined angle, the control section 11 judges that the user is likely to be viewing the display section included in the display section housing with the smaller tilt angle, and controls the luminance of the display section included in the display section housing with the larger tilt angle. Therefore, reflection in the display section on the side on which the user is focusing is effectively reduced, and the visibility of the display section can be ensured. In addition, even when contents displayed in the display section on the side on which the user is not focusing becomes difficult to view, the user is able to recognize at least an overview of the displayed contents.

Furthermore, when the luminance of the display section included in the display section housing with the larger tilt angle is controlled, the luminance of the display section is turned OFF or lowered depending on whether or not the larger tilt angle is larger than a predetermined angle. Therefore, for example, when one display section housing is in a substantially vertical state, judgment can be made that only the display section included in the other display section housing is being viewed, and the luminance of the display section of the display section housing in the substantially vertical state can be turned OFF. When neither housing is in a substantially vertical state, judgment can be made that the display section included in the one display section housing is mainly being viewed, and the luminance of the display section not mainly being viewed can be effectively reduced.

Still further, when judgment is made that the difference of the tilt angles (roll angles from the horizontal plane) of the display section housings 1 and 2 detected by the housing tilt angle detecting section 18 is greater than a predetermined angle, the display of the display section included in the display section housing with the larger tilt angle is turned OFF. Therefore, reflection in the display section on the side on which the user is focusing can be effectively prevented, and the energy consumption of the mobile phone 100 can be reduced.

When the opening angle of the display section housings 1 and 2 is less than a predetermined angle, if the difference of the tilt angles (roll angles from the horizontal plane) of the display section housings 1 and 2 detected by the housing tilt detecting section 18 is less than a predetermined angle, judgment is made that the user is likely to be viewing the display sections included in both housings, and the luminance of the display sections included in the housings are respectively controlled. Therefore, reflection in both display sections can be reduced, and the visibility of the display sections can be ensured.

Second Embodiment

A second embodiment of the present invention will hereinafter be described with reference to FIG. 6 to FIG. 8.

As described above, in the first embodiment, when the opening angle of the display section housings 1 and 2 is less than a predetermined angle (90°), the control section 11 judges whether the user is viewing the display section 4 or the display section 5 based on the tilt angles of the display section housings 1 and 2. However, in the second embodiment, when the opening angle of the display section housings 1 and 2 is smaller than a predetermined angle (90°), the control section 11 analyzes a facial image of the user captured by the in-camera 16, and after detecting an eye-gaze direction from the eyes of the user, judges whether the user is viewing (focusing on) the display section 4 or the display section 5 based on the direction of the eye-gaze. Note that sections that are basically the same in both embodiments and sections having the same name in both embodiments are given the same reference numerals, and descriptions thereof are omitted. Further, note that in the descriptions below, the characteristic portion of the second embodiment will mainly be described.

Figure 6:
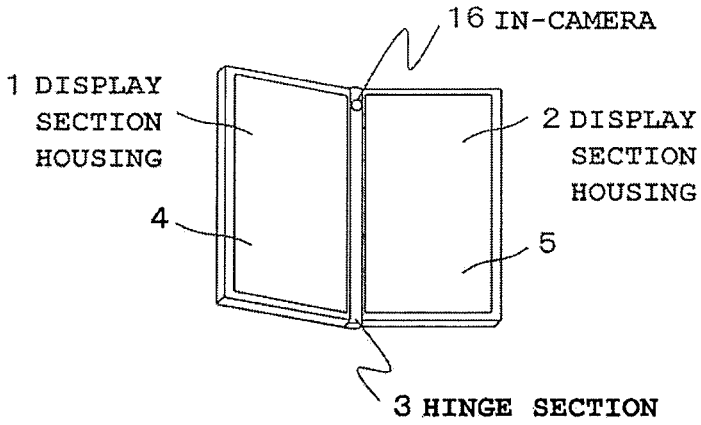
FIG. 6 is a diagram showing the mounting position of an in-camera 16 in a second embodiment, in which the display section housing 1 and the display section housing 2 are in an opened state (horizontally opened state)
Figure 7B:
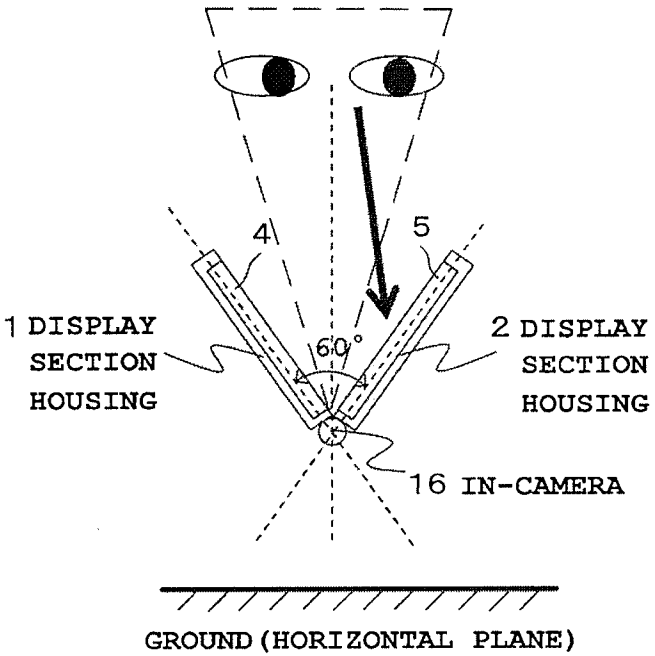
FIG. 7A and FIG. 7B are diagrams of examples where the opening angle of the display section housing 1 and the display section housing 2 is less than a predetermined angle (90°), and whether a user is viewing the display section 4 or the display section 5 is judged by detection of the eye-gaze direction of the user, in the second embodiment.
Figure 7A:
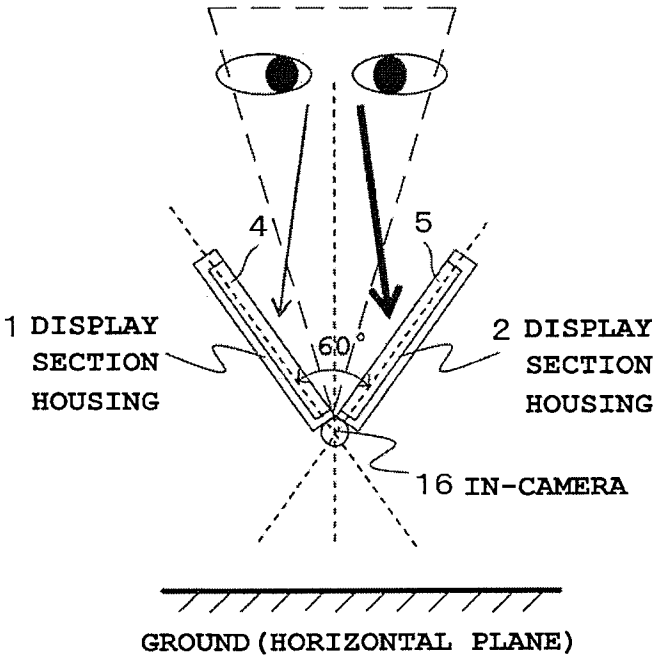

FIG. 6 is a diagram showing the mounting position of the in-camera 16 when the display section housings 1 and 2 are in an opened state (horizontally opened state). The in-camera 16 is provided in the upper end portion of the hinge section 3 on the side where the display sections 4 and 5 are exposed in the opened state. FIG. 7A and FIG. 7B are diagrams of examples where the opening angle of the display section housings 1 and 2 is less than a predetermined angle (90°), and whether the user is viewing the display section 4 or the display section 5 is judged by the detection of the eye-gaze direction of the user. That is, FIG. 7A and FIG. 7B show the image capturing direction of the in-camera 16, and specific examples where the gaze directions of both eyes are identified from the pupils of the user's eyes, and whether the user is viewing (focusing on) the display section 4 or the display section 5 is indicated based on the eye-gaze directions. In FIG. 7A, the user is mainly viewing the display section 5 of the display section housing 2. In FIG. 7B, the user is viewing only the display section 5 of the display section housing 2 (not viewing the other display section 4). In FIG. 7A and FIG. 7B, whether the user is mainly viewing the display section 5 or is viewing only the display section 5 has been judged based on the position of the user's left pupil.

Figure 8:
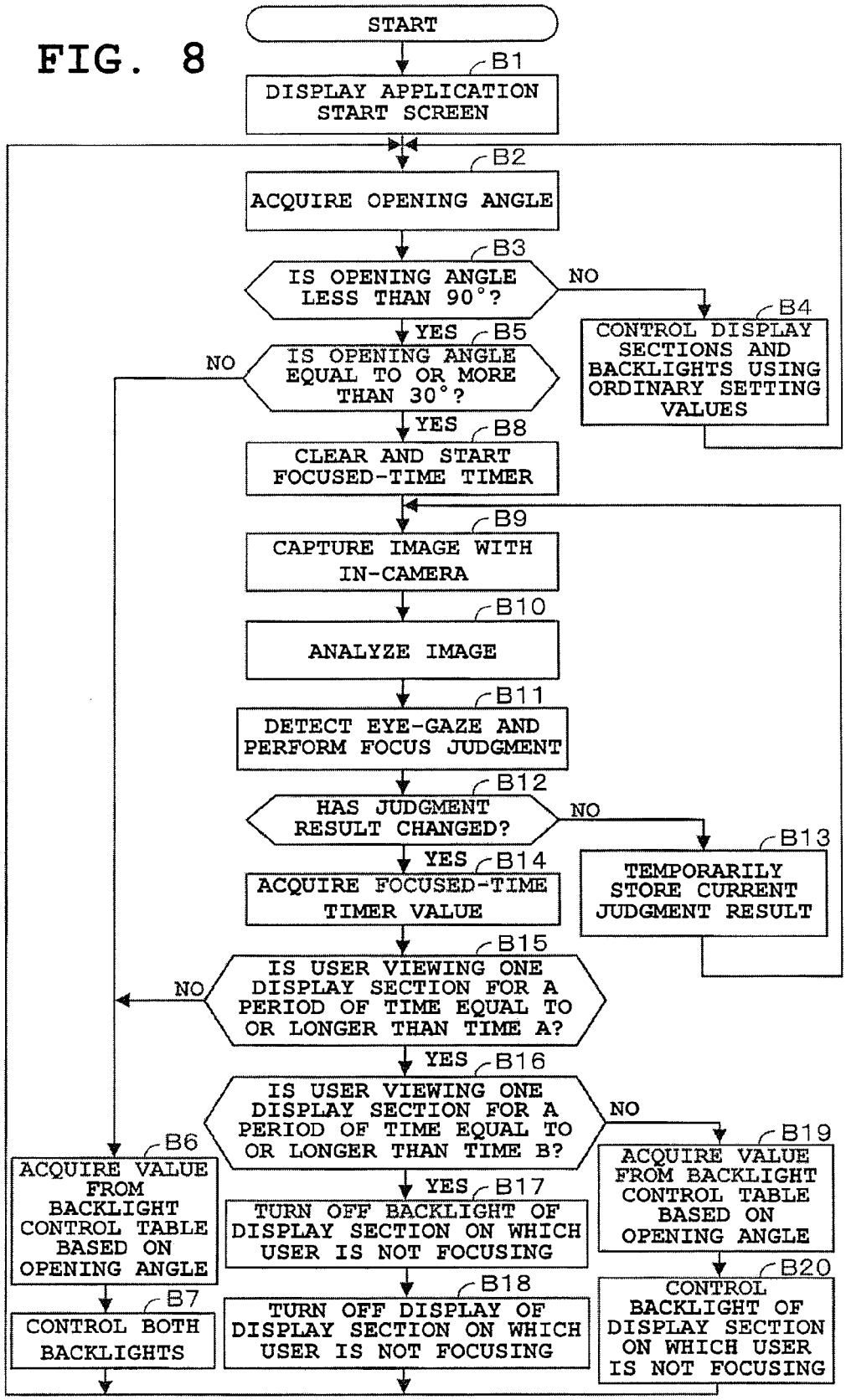
FIG. 8 is a flowchart outlining operations of the characteristic portion of the second embodiment which are activated with the initiation of a selected application.

FIG. 8 is a flowchart outlining operations of the characteristic portion of the second embodiment from among all of the operations of the mobile phone 100. As in the case of the above-described operations in FIG. 4, the operations in FIG. 8 are activated with the initiation of a selected application.

First, when a selected application is activated, the control section 11 displays its application screen on the display sections 4 and 5 (Step B1), and after acquiring a detection result from the opening angle detecting section 17 (Step B2), judges whether or not the "opening angle" is less than 90° (Step B3). When judged that the "opening angle" is equal to or more than 90° (NO at Step B3), the control section 11 controls the display sections 4 and 5 and the backlights 8 and 9 using ordinary setting values (Step B4). In this case, "×1" has been set as the "drive current angle correction" corresponding to when the "opening angle" is equal to or more than 90° in the backlight control table BT. Therefore, the control section 11 drives the backlights 8 and 9 with ordinary luminance. Then, the control section 11 returns to Step B2, and thereafter drives the backlights 8 and 9 with ordinary luminance in the same manner, on the condition that the opening angle is equal to or more than 90°.

Conversely, when judged that the "opening angle" is less than a predetermined angle (90°) (YES at Step B3), the control section 11 further judges whether or not the "opening angle" is equal to or more than another predetermined angle (30°) (Step B5). When the judged that the "opening angle" is less than 30°(NO at Step B5), the control section 11 judges that the user is likely to be viewing neither display section 4 or 5, and after proceeding to Step B6, reads out a corresponding "drive current angle correction" based on the opening angle, with reference to the backlight control table BT. In this instance, since the "drive current angle correction" when the opening angle is equal to or less than 30° is "OFF", the control section 11 turns OFF both backlights 8 and 9 (Step B7). Then, the control section 11 returns to the above-described Step B2.

When judged that the "opening angle" is less than 90° (YES at Step B3) and equal to or more than 30° (YES at Step B5), the control section 11 judges that the user is likely to be viewing at least one of the display sections 4 and 5, and further judges that the contents of each display section 4 and 5 are likely to be reflected in the other display section by reflected light. Accordingly, the control section 11 proceeds to subsequent Step B8, and after clearing the contents of a focused-time timer (not shown), initiates the counting operation of the focused-time timer. This focused-time timer measures focused-time used to indicate which display section 4 or 5 the user is continuously viewing (focusing). Then, the control section 11 drives the in-camera 16 to capture the face of the user (Step 39), and after acquiring a captured image, analyzes the image (Step B10). As a result, the gaze directions of both eyes are detected from the positions of the pupils of eyes. Next, based on these eye-gaze directions, the control section 11 judges whether the user is viewing (focusing on) the display section 4 or the display section 5 (Step B11).

Then, the control section 11 judges whether or not the judgment result has changed (Step B12). In the initial operation, the control section 11 detects no change (NO at Step B12), and therefore temporarily stores the current judgment result as a previous judgment result (Step B13). The control section 11 then returns to above-described Step 39, and after acquiring and analyzing a captured image (Step B10), detects eye-gaze directions and performs focus judgment (Step B11). Thereafter, the control section 11 repeatedly performs the above-described operations while comparing a current judgment result and a previous judgment result, until a change in a judgment result is detected. When a change in a judgment result is detected (YES at Step B12), the control section 11 acquires the time measured by the above-described focused-time timer (not shown) (Step B14), and judges whether the user has continuously viewed (focused on) one display section for a period of time equal to or longer than time A (such as two seconds), based on the measured time (focused-time) (Step B15).

When judged based on the positions of both pupils that the focused-time over which the user is viewing one display section is less than time A, (NO at Step B15), the control section 11 judges that the user is viewing both display sections 4 and 5, and after proceeding to subsequent Step B6, reads out a corresponding "drive current angle correction" based on the opening angle, with reference to the backlight control table BT. Then, based on this "drive current angle correction", the control section drives each of the backlights 8 and 9 corresponding to the display sections 4 and 5 (Step B7). If this opening angle is, for example, 60°, the corresponding "drive current angle correction" is "×0.8". Therefore, each backlight 8 and 9 is driven with a luminance that is 20% lower than the ordinary luminance. Then, the control section 11 returns to above-described Step B2.

Conversely, when judged that the focused-time over which the user is viewing one display section is equal to or longer than time A (YES at Step B15), the control section 11 further judges whether or not the focused-time over which the user is viewing one display section is equal to or longer than time B (such as eight seconds) (Step B16). When judged that the focused-time is equal to or longer than time A and less than time B (NO at Step B16), the control section 11 judges that the user is mainly viewing one display section, and after proceeding to subsequent Step B19, reads out a corresponding "drive current angle correction" based on the opening angle, with reference to the backlight control table BT. Then, based on this "drive current angle correction", the control section 11 drives the backlight of the display section on which the user is not focusing, (Step B20). In the instance in FIG. 7A, the opening angle is 60°, and the corresponding "drive current angle correction" is "×0.8". Therefore, the backlight 8 of the display section 4 on which the user is not focusing is driven with a luminance that is 20% lower than the ordinary luminance. Then, the control section 11 returns to above-described Step B2.

When judged that the focused-time is equal to or longer than time B (YES at Step B16), the control section 11 judges that the user is focusing on only one display section, and after proceeding to Step B17, turns OFF the backlight of the display section on which the user is not focusing so as to set the luminance in an OFF state (Step B17), and sets the display of this display section in an OFF state (power supply blocked state) (Step B18). In the instance in FIG. 7B, the control section 11 turns OFF the backlight 8 of the display section 4 on which the user is not focusing, and sets the display of the display section 4 in an OFF state. Then, the control section 11 returns to above-described Step B2.

As described above, in the second embodiment, the control section 11 controls the luminance of a display section on which the user is not focusing from among the display sections 4 and 5 included in the display section housings 1 and 2, when the opening angle of the display section housings 1 and 2 detected by the opening angle detecting section 17 is less than a predetermined angle. Therefore, reflection in the display section on the side on which the user is focusing is effectively reduced, and the visibility of the display section can be ensured. In addition, even when contents displayed in the display section on the side on which the user is not focusing becomes difficult to view, the user is able to recognize at least an overview of the displayed contents.

In addition, the display sections 4 and 5 are display devices that use the backlights 8 and 9, and the luminance of these backlights 8 and 9 are reduced. Therefore, reflection that occurs in a display device using a backlight is effectively reduced.

Moreover, when the luminance of a display section on which the user is not focusing is controlled, this display section is turned OFF or the luminance thereof is reduced depending on whether or not the focused-time over which the user is focusing on the other display section is longer than a predetermined amount of time. Therefore, when the focused-time is longer than a predetermined amount of time, judgment can be made that the user is only viewing one display section, and the luminance of the other display section on which the user is not focusing can be set in an OFF state. In addition, when the focused-time is not longer than a predetermined amount of time, judgment can be made that the user is mainly viewing one display section, and the luminance of the other display section that the user is not mainly viewing can be effectively reduce.

Furthermore, when the user is focusing on each of the display sections 4 and 5, the luminance of each display section 4 and 5 is reduced. Therefore, reflection in both display sections is reduced, and the visibility of the display sections can be ensured.

Still further, the display of a display section is set to an OFF state when the user is not focusing on the display section. Therefore, reflection in the other display section on which the user is focusing can be prevented, and the energy consumption of the mobile phone 100 can be reduced.

Yet still further, The control section 11 judges in which display section the user is focusing, by analyzing the image of the user captured by the in-camera 16. Therefore, the display section on which the user is focusing can be easily determined without fail.

Figure 9A:
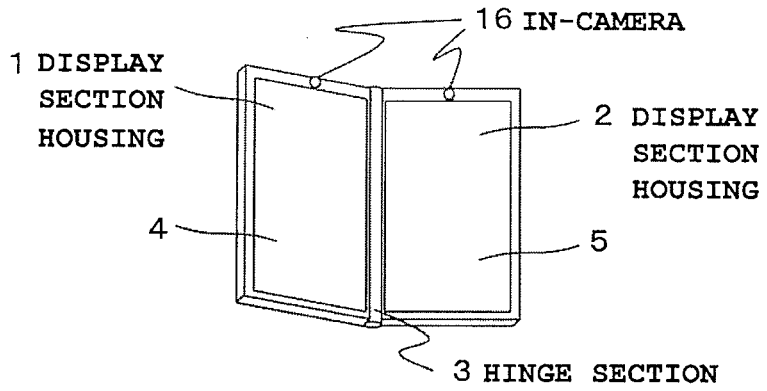
FIG. 9A to FIG. 9C are diagrams for explaining variation examples of the second embodiment.
Figure 9B:
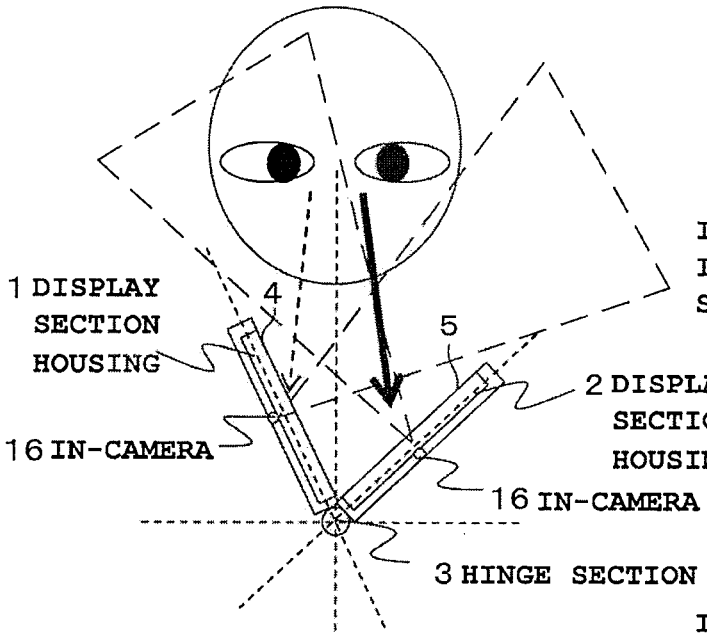

Note that, in the above-described second embodiment, although the in-camera 16 is provided in the upper end portion of the hinge section 3, the mounting position of the in-camera 16 is not limited thereto. As shown in FIG. 9A, the in-camera 16 may be mounted in the upper end center portion of each display section housing 1 and 2. As a result, the image-capturing direction of each in-camera 16 corresponds to the tilt angle (the roll angle from the horizontal plane described in the first embodiment) of each display section housing 1 and 2, whereby the image-capturing direction of the in-camera 16 moves away from the center of the user's face as the tilt angle increases, as shown in FIG. 9B. For example, in the example shown in FIG. 9B, if the tilt angle of the display section housing 1 is 70° and the tilt angle of the display section housing 2 is 40°, the image-capturing direction of the in-camera 16 on the display section housing 1 side is directed toward a position away from the user's face. However, the image-capturing direction of the in-camera 16 of the display section housing 2 side is directed toward the position of the left-half of the user's face.

Figure 9C:
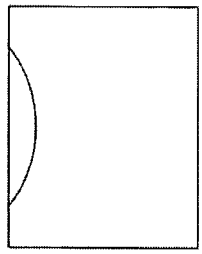
Figure 9C:
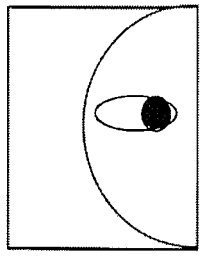

FIG. 9C is a diagram showing images respectively captured by the in-cameras 16. The user's face is barely captured in the image (upper image in FIG. 9C) captured by the in-camera 16 on the display section housing 1 side (display section 4 side), while half of the user's face is captured in the image (lower image in FIG. 9C) captured by the in-camera 16 on the display section housing 2 side (display section 5 side). In this instance, the control section 11 compares each of the captured images, and judges that the image including a larger face area and a larger skin-colored area is that of the display section on which the user is focusing. Alternatively, the control section 11 determines the display section on which the user is focusing by judging whether or not the user's eye is included in the image, and locating the position of the eye in the image. As a result, a display section on which the user is focusing can be more easily determined.

In each of the above-described embodiments, display devices that use backlights have been adopted as the display sections 4 and 5. However, the display sections 4 and 5 may be self-luminous display devices such as organic electroluminescent devices. In this case, the angle correction in the backlight control table BT may be applied to a pixel parameter that sets luminescence intensity, and the like. Even when self-luminous display devices such as these are adopted, reflection can be effectively reduced as in the case of the display devices that use backlights.

Also, in each of the above-described embodiments, an example has been given in which the vertically long display section housings 1 and 2 are used in an opened state where they are horizontally aligned (horizontally opened state). However, the present invention is not limited thereto and, for example, a configuration may be adopted in which horizontally long display housings are used in an opened state where they are vertically aligned (vertically opened state). In addition, although an example in which two housings are opened has been given in each of the above-described embodiments, the present invention is not limited thereto, and a structure may be adopted in which three or more housings are opened and used.

Moreover, in each of the above-described embodiments, the control section 11 judges that reflection is likely to occur when the opening angle of the display section housings 1 and 2 detected by the opening angle detecting section 17 is less than 90°. However, this angle may be set to 120°, 75°, or the like depending on the housing structure. In addition, a configuration may be adopted in which the user can optionally set this angle.

Furthermore, in each of the above-described embodiments, the present invention has been applied to a foldable-type mobile phone. However, the structure of the mobile phone is not limited thereto, and an optional housing structure such as a double-axis hinged-type, a sliding-type, or a rotating-type may be used. In addition, the present invention may be applied not only to a mobile phone but also to a personal computer, a personal digital assistant (PDA), a digital camera, a music player, etc.

Still further, the "devices" or the "units" described in each of the above-described embodiments are not required to be in a single housing, and may be separated into a plurality of housings by function. In addition, the steps in the above-described flowcharts are not required to be processed in time series, and may be processed in parallel, or individually and independently.

While the present invention has been described with reference to the preferred embodiments, it is intended that the invention be not limited by any of the details of the description therein but includes all the embodiments which fall within the scope of the appended claims.

What is claimed is:

1. A terminal device including two housings respectively having a display section which are foldably connected via a hinge section, comprising:

an opening angle judgment means for detecting an opening angle of the two housings, and judging whether or not the opening angle is smaller than a first predetermined angle;

a display control means for controlling luminance of at least one display section of the two housings based on the opening angle, when the opening angle judgment means judges that the opening angle is smaller than the first predetermined angle; and an angle difference judgment means for, when the two housings are in a state of being opened, judging whether or not an angle difference between a first angle and a second angle is greater than a second predetermined angle, where the first angle is a smaller angle of two angles formed by a short side of one of the two housings and a horizontal plane, and the second angle is a smaller angle of two angles formed by a short side of the other of the two housings and the horizontal plane, wherein the display control means reduces luminance of a display section included in a housing with a larger angle of the first angle and the second angle, when the opening angle judgment means judges that the opening angle is smaller than the first predetermined angle and the angle difference between the first angle and the second angle is greater than the second predetermined angle.

2. The terminal device according to claim 1, wherein the display control means sets the luminance of the display section to an OFF state or reduces the luminance of the display section depending on whether or not the larger angle of the first angle and the second angle is larger than a third predetermined angle, when controlling the luminance of the display section included in the housing with the larger angle of the first angle and the second angle.

3. The terminal device according to claim 1, wherein the display control means sets display of a display section included in a housing with a larger angle of the first angle and the second angle to an OFF state, when the opening angle judgment means judges that the opening angle is smaller than the first predetermined angle and the angle difference judgment means judges that the difference between the first angle and the second angle is greater than the second predetermined angle.

4. The terminal device according to claim 1, wherein the display control means reduces luminance of each display section, when the opening angle judgment means judges that the opening angle is smaller than the first predetermined angle, and the angle difference judgment means judges that the difference between the first angle and the second angle is smaller than the predetermined angle.

5. The terminal device according to claim 1, further comprising:

a focus judgment means for judging on which display section a user is focusing among two display sections included in the two housings;

wherein the display control means reduces luminance of a display section judged by the focus judgment means as not being focused, when the opening angle judgment means judges that the opening angle is smaller than the predetermined angle.

6. The terminal device according to claim 5, wherein the focus judgment means judges on which display section the user is focusing among the two display sections, based on a focused-time; and the display control means sets the luminance of the display section to an OFF state or reduces the luminance of the display section depending on whether or not the focused-time is longer than a predetermined time, when controlling the display section judged by the focus judgment means as not being focused.

7. The terminal device according to claim 5, wherein the display control means reduces luminance of each display section, when the focus judgment means judges that the user is focusing on each of the two display sections.

8. The terminal device according to claim 1, further comprising:

a focus judgment means for judging on which display section a user is focusing among two display sections included in the two housings;

wherein the display control means sets display of a display section judged by the focus judgment means as not being focused to an OFF state, when the opening angle judgment means judges that the opening angle is smaller than the predetermined angle.

9. The terminal device according to claim 5, wherein the focus judgment means judges on which display section the user is focusing among the two display sections, by analyzing a captured image of the user.

10. The terminal device according to claim 1, wherein the display section is a display device using a backlight; and the display control means reduces luminance of the backlight.

11. The terminal device according to claim 1, wherein the display device is a self-luminous display device; and the display control means reduces luminance of the self-luminous display section.

12. A non-transitory computer-readable storage medium having stored thereon a program that is executable by a computer, the program being executable by the computer to perform functions comprising:

opening angle judgment processing for detecting an opening angle of two housings respectively having a display section which are foldably connected via a hinge section, and judging whether or not the opening angle is smaller than a first predetermined angle;

display control processing for controlling luminance of the display section based on the opening angle, when the opening angle is judged to be smaller than the first predetermined angle; and an angle difference judgment processing for, when the two housings are in a state of being opened, judging whether or not an angle difference between a first angle and a second angle is greater than a second predetermined angle, where the first angle is a smaller angle of two angles formed by a short side of one of the two housings and a horizontal plane, and the second angle is a smaller angle of two angles formed by a short side of the other of the two housings and the horizontal plane, wherein the display control processing reduces luminance of a display section included in a housing with a larger angle of the first angle and the second angle, when the opening angle judgment processing judges that the opening angle is smaller than the first predetermined angle and the angle difference between the first angle and the second angle is greater than the second predetermined angle.

* * * * *